US011428022B1

(12) United States Patent
Rodriguez et al.

(10) Patent No.: US 11,428,022 B1
(45) Date of Patent: Aug. 30, 2022

(54) POLE SUPPORT FOR POOL/SPA MAINTENANCE TOOLS

(71) Applicants: David Elio Rodriguez, Gainesville, FL (US); Maria T Wilson, Gainesville, FL (US)

(72) Inventors: David Elio Rodriguez, Gainesville, FL (US); Maria T Wilson, Gainesville, FL (US)

( * ) Notice: Subject to any disclaimer, the term of this patent is extended or adjusted under 35 U.S.C. 154(b) by 0 days.

(21) Appl. No.: 16/810,355

(22) Filed: Mar. 5, 2020

Related U.S. Application Data

(60) Provisional application No. 62/814,381, filed on Mar. 6, 2019.

(51) Int. Cl.
*E04H 4/14* (2006.01)

(52) U.S. Cl.
CPC ..... *E04H 4/144* (2013.01)

(58) Field of Classification Search
CPC ..... E04H 4/14; E04H 4/144; E04H 4/1609; E04H 4/1618
USPC ..... 248/113
See application file for complete search history.

(56) References Cited

U.S. PATENT DOCUMENTS 994,005 A 5/1911 Jones
1,530,180 A * 3/1925 Thomasw ..... A47K 1/09 211/65
2,793,902 A 5/1957 Govan, Jr.
2,984,486 A 5/1961 Jones
4,247,216 A 1/1981 Pansini
4,893,363 A * 1/1990 Huff ..... E04H 4/144 108/47
4,903,926 A * 2/1990 McNarry ..... E04H 4/14 211/86.01
5,062,816 A 11/1991 Berglund et al.
5,173,181 A * 12/1992 McFarland ..... B01D 29/27 15/1.7
5,342,513 A 8/1994 Wall et al.
D358,691 S * 5/1995 Engle ..... D32/54
5,705,058 A * 1/1998 Fischer ..... E04H 4/1263 210/237
5,815,977 A 10/1998 Hill, Jr.
5,857,226 A * 1/1999 Sommer ..... A47C 15/004 4/496
5,867,868 A 2/1999 Ward
(Continued)

FOREIGN PATENT DOCUMENTS

CA 2281068 2/2000
GB 2208156 3/1989
WO WO-2020107075 A1 * 6/2020 ..... E06C 1/39

*Primary Examiner* — Eret C McNichols
(74) *Attorney, Agent, or Firm* — John Rizvi; John Rizvi, P.A.—The Patent Professor®

(57) ABSTRACT

A pole support removably attachable to pole of a pool/spa maintenance tool to prevent the maintenance tool from slipping and falling into the pool. The pole support includes a support base, a pair of outriggers extending upwards and outwards from the support base, and an adjustable fastener system for attaching the support base to selective areas along the longitudinal outer surface of the pole. The outriggers may include a straight and/or curved configuration, and a friction material, to further enhance the gripping features of the outriggers when positioning the outriggers on a surface to secure the maintenance tool in place.

19 Claims, 13 Drawing Sheets

(56) References Cited

U.S. PATENT DOCUMENTS 5,951,858 A * 9/1999 Soto ..... E04H 4/1609 210/167.2
6,422,623 B1 7/2002 Thomas
6,540,430 B2 * 4/2003 Hsu ..... A01B 1/222 248/113
6,793,547 B2 9/2004 Shofer
6,989,093 B1 * 1/2006 Greathead ..... E04H 4/1254 210/167.19
7,014,231 B1 3/2006 Callen
7,309,088 B2 12/2007 Fiore
7,409,740 B1 8/2008 Geigan
7,971,914 B1 7/2011 Pladson
8,091,934 B2 1/2012 Bair
8,992,277 B2 3/2015 Macias
9,212,497 B2 * 12/2015 Chlapaty ..... A47C 4/286
9,474,380 B2 * 10/2016 Chlapaty ..... A47C 1/14
9,926,714 B2 * 3/2018 Cusic ..... E04H 4/14
9,943,953 B2 4/2018 Fritz
2004/0064996 A1 4/2004 Armenti
2005/0011819 A1 * 1/2005 Gillen ..... B01D 21/2433 210/121
2005/0167551 A1 * 8/2005 Leroux ..... B65F 1/141 248/153
2006/0278773 A1 12/2006 Westgarde
2007/0000227 A1 1/2007 Mazar et al.
2010/0123063 A1 * 5/2010 Bauchet ..... A47B 96/07 248/274.1
2011/0089294 A1 * 4/2011 Buytaert ..... H02G 3/30 248/58
2011/0099708 A1 * 5/2011 Freedman ..... A47C 4/28 4/496
2012/0192540 A1 8/2012 Macyszyn
2016/0242351 A1 8/2016 Richmond
2020/0157830 A1 * 5/2020 Evans ..... E04H 4/1609
2021/0172190 A1 * 6/2021 Steinman ..... A47B 5/02

* cited by examiner

POLE SUPPORT FOR POOL/SPA MAINTENANCE TOOLS

CROSS-REFERENCE TO RELATED APPLICATIONS

This application claims the benefit of U.S. Provisional Patent Application No. 62/814,381, filed on Mar. 6, 2019, which is incorporated by reference herein in its entirety.

FIELD OF THE INVENTION

The present invention relates generally to supports, and more particularly, to a pole support that is adjustably attached to the exterior surface of a pole of a pool/spa maintenance tool and used to prevent the maintenance tool from slipping and falling into a pool or spa.

BACKGROUND OF THE INVENTION

A summer recreational activity that is often enjoyed by a host of individuals is soaking in a cool refreshing pool during hot days, or relaxing in the warmer waters of a spa during evening hours. Adults and children alike often enjoy swimming and playing in pools, whether private or public. Some generally like the use of floatation devices to simply relax while floating on the surface of the pool, while others prefer playing water activities by using a variety of water toys. Another favorable activity enjoyed by many involves relaxing in a spa to experience the pulsing and relaxing force of water jets. The hot jetted water bombards the body and helps to relieve tension and provide a massaging effect on the muscles and other body parts. As such, it is increasingly common for households to have both a pool and spa for use during different times of the day or year.

During use, it is very common for individuals to introduce dirt, grass or grime into a pool or spa when transitioning in and out of the water. For example, children often jump consistently in and out of the pool or spa when playing in a pool thereby introducing foreign matter into the water as a result of dirt, or loos grass sticking to their feet. In addition, foreign matter, such as leaves and other debris often fall into pools or spas if not covered. Over time, such debris accumulates on the top surface of the water, or at the bottom of the pool or spa necessitating the owner to clean the pool and remove the dirt and debris using a variety of different pool or spa maintenance tools. Thus, it is often the case that a great deal of time is taken away from the enjoyable use of the pool or spa in order to clean and maintain the pool or spa in good working order.

There are various pool and spa accessories on the market today to better assist owners in cleaning or maintaining their pools or spas. Some maintenance tools generally include an elongate pole that typically comprises a series of pole segments that telescope with one another, where the pole has a handle at one end, and an accessory tool that is removably attached to the other end of the pole. Examples of pool or spa accessory tools may include some form of a hook, a brush, a pumice stone, or a net. An additional tool used for cleaning pool includes a skimmer that is attached to the end of the pole and is introduced into the pool where users simply navigate the pole and skimmer within the water and scoop up any debris floating on the top surface of the pool. Another maintenance tool includes a vacuum system generally used to collect any dirt or debris that has accumulated on the bottom of the pool. The vacuum system typically includes a pole having a handle, and a vacuum plate with wheels attached to the end of the handle and used to move along the bottom of the pool while vacuuming the debris.

It is not uncommon for pool owners to use a variety of pool maintenance tools when cleaning their pools or spas. Since each maintenance tool is designed for a particular purpose, owners often switch between tools when cleaning the pool thus often needing to store one tool on the ground or deck while using another. As a result of the constant interchange of tools, or simply during the use of such tools, it is often the case that maintenance tools slip and fall into the pool coming to rest on the bottom of the pool. As a result, the owner or service person has to retrieve the tool from the pool with added effort and strain, a task that can be repeated during a single cleaning of the pool.

Conventional practices have attempted to address the matter of temporarily or permanently storing pool maintenance tools. In one example, supports, such as hooks, are often permanently installed on a deck, fence wall, or on a storage shed, where users insert the pole of the pool maintenance tools within the hooks. For added convenience, other prior art devices have employed support devices that are attached directly to the pool maintenance tool itself. For example, prior art discloses the use of support devices that have ground penetration retainers, the use of tethers such as a rope or straps, devices that allow users to attach the tool directly to their body, and devices that are permanently fixed to the elongate pole of the tool using screws, or bolts and nuts. The conventional prior art has certain drawbacks as being either too cumbersome to use; require certain conditions be present, are time consuming to implement, or compromise the functional characteristics of the tool itself. For example, attaching a pool maintenance tool to a person's body may interfere with the person walking around or carrying out other actions. Also, ground penetration devices require certain conditions such as softer ground. In turn, using a tether such as a rope or strap may be time consuming, as it typically requires making proper attachments to both the tool and holding surface. As to the use of screws or bolts and nuts for attaching a pole support to a pole of a tool, such use can compromise the operative features of telescoping poles.

Accordingly, there is an established need for a pole support for pool/spa maintenance tools that solves at least one of the aforementioned problems. For example, the pole support should be easy and convenient to use, and should minimize the risk of the pole falling into the pool/spa.

SUMMARY OF THE INVENTION

The present invention is directed to a pole support that is adjustably attachable to the outer surface of a pole of a pool/spa maintenance tool to prevent the maintenance tool from slipping and falling into a pool. The pole support can be adjustably attached to a host of different pool maintenance tools in order to quickly retain and hold the tool in place on a surface ledge such as a pool wall or the like, without having the tool slip and fall into the pool. The pole support is fast and easy to install, can be used on poles having different diameters, and is less cumbersome to use than conventional supports. The pole support includes a support base, a pair of outriggers that are each attached to the support base and designed to securely engage with a surface ledge such as a pool wall, and an adjustable fastener system employed to secure the support base along the outer surface of a pole of a pool maintenance tool. The outriggers may include a friction material that is disposed on each outrigger to enhance the coefficient of friction for each outrigger to provide a firm, holding feature of the outriggers.

In a first implementation of the invention, a pole support for a pool or spa maintenance tool comprises a support base, a first outrigger and a second outrigger. The support base is releasably attachable to a pole of a pool maintenance tool. The first outrigger is attached to the support base and includes a first segment extending generally upwards from the support base and a second segment conjoined with the first segment and extending generally rearward of the support base. Similarly, the second outrigger is attached to the support base and includes a first segment extending generally upwards form the support base and a second segment conjoined with the first segment and extending generally rearward of the support base. The pole support further includes a fastener system configured to attach the support base to the pole with a front side of the support base abutting against the pole.

In a second aspect, the first outrigger and second outrigger may form part of a single-piece unit. The single-piece unit may further include a U-shaped connecting portion connecting the first outrigger to the second outrigger. The U-shaped connecting portion may be attached to a rear surface of the support base.

In another aspect, the first segment of the first outrigger and the first segment of the second outrigger may be parallel to each other.

In another aspect, the first segment of the first outrigger and the first segment of the second outrigger may be divergent from each other.

In another aspect, the first segment of the first outrigger and the first segment of the second outrigger may be straight.

In another aspect, the second segment of the first outrigger and the second segment of the second outrigger may be curved.

In another aspect, the second segment of the first outrigger and the second segment of the second outrigger may be straight.

In another aspect, the first and second segments of both the first outrigger and the second outrigger may be straight. The first and second segments of the first outrigger may be perpendicular to each other. Similarly, the first and second segments of the second outrigger may perpendicular to each other.

In another aspect, at least one of the first and second outriggers may include a friction material disposed thereon to prevent slippage when said at least one of the first and second outriggers rests on a surface.

In another aspect, both the first and second outriggers may include a friction material disposed on the first and second segments thereof to prevent slippage when said first and second outriggers rest on a surface.

In another aspect, the first outrigger may include a distal end conjoined with the second segment of the first outrigger. Similarly, the second outrigger may include a distal end conjoined with the second segment of the second outrigger. The distal ends of the first and second outriggers may extend generally downward of the second segment of the first and second outriggers, respectively, each of the first and second outriggers forming a hook-type configuration.

In another aspect, the distal ends of the first and second outriggers may be straight.

In another aspect, the distal ends of the first and second outriggers may be curved.

In another aspect, the distal ends of the first and second outriggers may include a friction material disposed thereon to prevent slippage when said distal ends rest on a surface.

In another aspect, the fastener system may include a flexible sleeve configured to wrap around the pole.

In another aspect, the fastener system may include a quick release cam lock fastener system.

In another aspect, the fastener system may be removably connectable to the support base.

In another aspect, the fastener system may be permanently carried by the support base.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which:

FIG. 1.2 presents a side elevation view of a pool maintenance tool including a vacuum plate with wheels pivotably attached to one end of a pole, and including the pole support of FIG. 8, showing pole support hooked onto a pool wall.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the term's "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a pole support that is adjustably attached to the outer body of a pole of a pool/spa cleaning or maintenance tool to conveniently retain the tool in place, in an elevated or erect position, so as to prevent the cleaning tool from slipping or falling to the ground or within the pool or spa.

Figure 1:
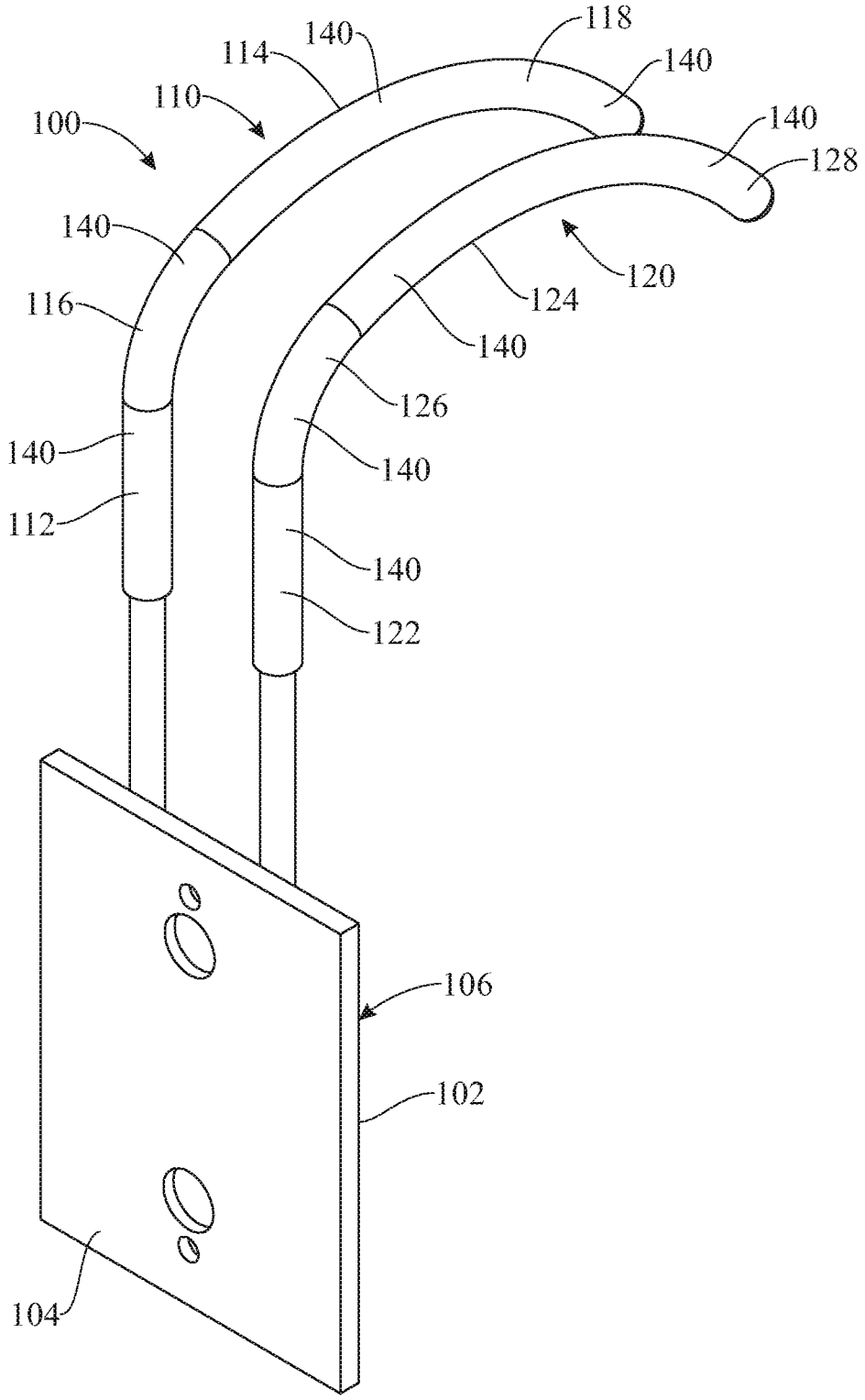
FIG. 1 presents a top, front isometric view of a pole support including outriggers attached to a support base, in accordance with a first illustrative embodiment of the present invention.
Figure 2:
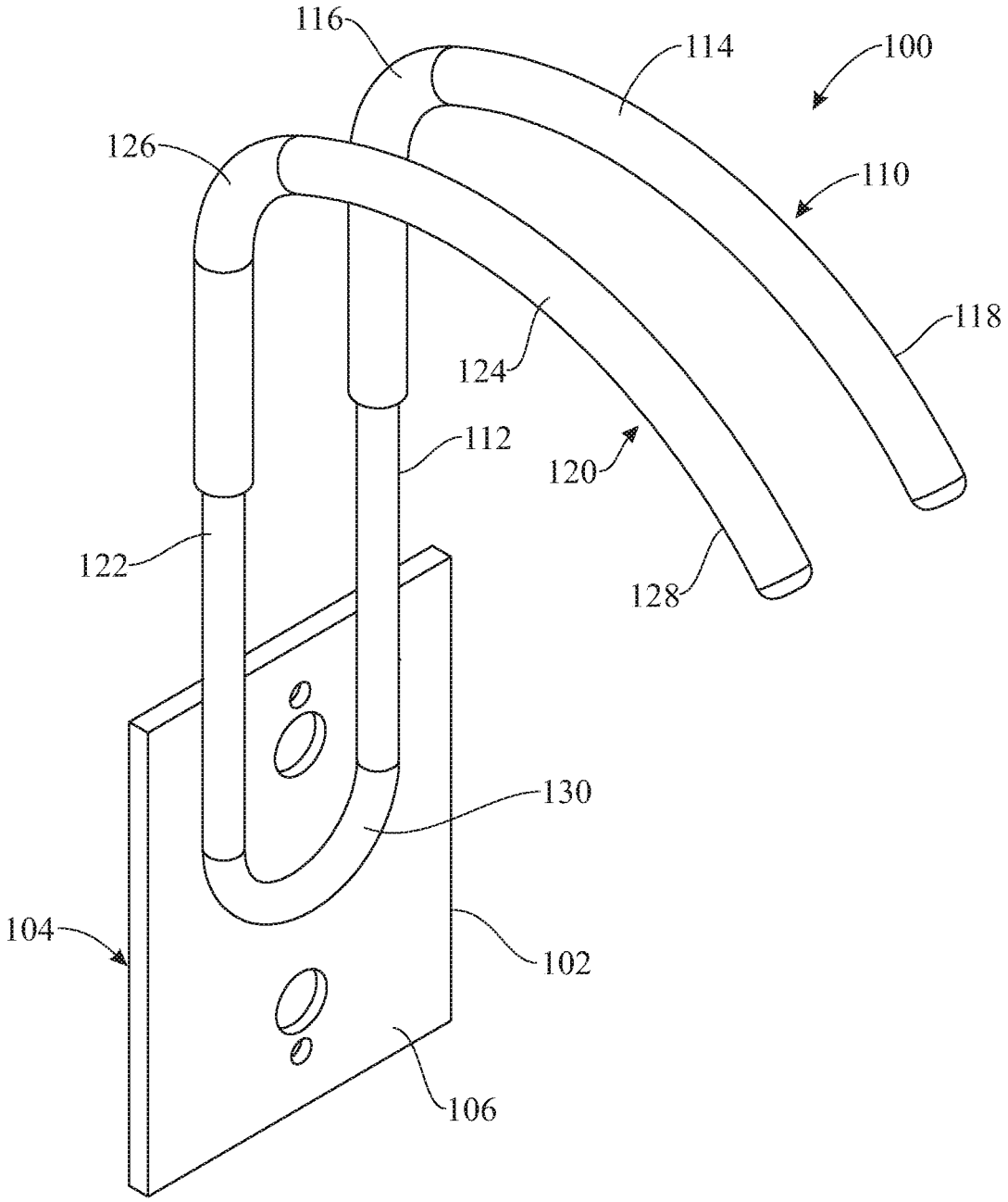
FIG. 2 presents a top, rear isometric view of the pole support of FIG. 1.

Referring now to FIGS. 1 and 2, there is shown a pole support 100 mountable to a pole of a pool or spa maintenance tool for preventing the tool from slipping and falling into the pool, in accordance with one embodiment of the present invention. The pole support 100 is configured for use with a variety of pool/spa cleaning or maintenance tools that generally include an elongate pole or telescoping poles having a handle, and a pool maintenance accessory that is coupled to the distal end of the pole. As such, a pool maintenance tool may include a pole including any one of maintenance accessories such as, but not limited to, a net, brush, hook, scrapper, pumice stone, skimmer, or squeegee that is permanently or releasably attached to the end of the pole. Other pool maintenance or cleaning tools may include a pool vacuum cleaning system, or camera inspection system. As such, the embodiments of the pole support 100, of the present invention, can be used with a host of different pool or spa cleaning or maintenance tools and accessories available.

In some embodiments, such as the present embodiment, the pole support 100 includes a support base 102 that is engineered to securely attach to the outer surface of a pole of a pool maintenance tool. The support base 102 has an outer or front surface 104 and an inner or rear surface 106. The support base 102 may comprise a variety of different geometrical configurations or dimensions, including round, square, rectangular, cross-shaped, oval, or any, other geometric shape. In some embodiments, such as the present embodiment, the support base 102 comprises a plate that may have a predetermined height and width, with the front and rear surfaces 104 and 106 formed parallel to one another (for example, the support base 102 of the present embodiment is formed as a rectangular plate). The width of the support base 102 may be selected to correlate with the width of a pool pole such that the support base 102 does not extend too far outwards beyond the width of the pool pole. Further, in some embodiments, the support base 102 may be generally flat, as shown; however, alternative embodiments are contemplated in which the support base 102 may include a curved formation to wrap partially around the geometrical shape of the pole when butting against the pole. The support base 102 is preferably, constructed from a rigid, durable material that is capable of withstanding impact should it come into contact with the ground. For example, the support base 102 may be constructed from a rigid, durable material, including but not limited to, aluminum, steel, wood, a hard resin or plastic. In an effort to resist rust or corrosion as a result to the support base 102 being exposed to the water or harsh chemicals typically used in pools, or spas, the support base 102 may comprise stainless steel, a galvanized steel, brass, or aluminum metal. Alternatively, a preventive coating may be applied to the support base 102 such as aluminum, zinc, cadmium, nickel-chromium, or cobalt-chromium to withstand corrosion.

With continued reference to FIGS. 1 and 2, the pole support 100 includes a pair of arms or outriggers 110, 120 where each outrigger extends upwards and rearwards a predetermined distance from the support base 102. In one embodiment, each outrigger is defined by a first segment that extends upwards, generally vertically, from the support base 102, and runs coextensive with, or is conjoined with, a second segment that is bent about the first segment a predetermined angle resulting in the second segment extending outwards and away from the first segment. More specifically, outrigger 110 includes an upwardly-extending first segment 112 and a rearward-extending second segment 114, which are interconnected by a connecting portion 116 providing the aforementioned predetermined angle. Similarly, outrigger 120 includes an upwardly-extending first segment 122 and a rearward-extending second segment 124, which are interconnected by a connecting portion 126 providing the aforementioned predetermined angle.

Each outrigger 110, 120 may include a host of different configurations. For example, the second segments 114, 124 of each outrigger 110, 120 may have a straight formation, or curved configuration, and include a variety of different slopes determined by the selection of angles and shapes of the connecting portions 116, 126 and second segments 114, 124. In one exemplary embodiment, a distal end 118, 128 of each outrigger 110, 120 may include a curved geometry to provide a hook configuration for easily resting the pole support 100 onto a surface ledge, such as a pool wall, thereby retaining the pool maintenance tool in place and preventing it from falling into the pool. It will be understood that each outrigger 110, 120 may also comprise any geometric shape and dimension. For example, the diameter of each outrigger 110, 120 may differ depending on the application of the pole support 100 needed. Pool or spa accessory or maintenance tools that are larger and heavier in size may require a larger pole support 100 whose outriggers 110, 120 are capable of supporting the added weight of a larger pool or spa maintenance tool when the pool pole is resting in place. In one non-limiting embodiment, the outriggers 110, 120 can be formed from a single or integral piece of material that is bent to form outriggers 110, 120 that are integrally joined together, via a U-shaped connecting segment or juncture 130, as better illustrated in FIG. 2, and attached to or integrally formed with the body of the support base 102. More specifically, the outriggers 110, 120 may be attached to or integrally formed with the rear surface 106 of the support base 102. In one alternative embodiment, each outrigger 110, 120 may comprise or be formed as a separate and distinct piece that is each attached to support base 102 where a proximal end of each outrigger 110, 120 is permanently attached to the support base 102 using any well-known technique such as welding, or using fasteners. In one exemplary embodiment, the pole support 100 may also be constructed from an injection molding process to form a single, integral unit to reduce the time, expense, and number of pieces needed to manufacture or assemble pole support 100. Also, each outrigger 110, 120 may include magnetic properties that are incorporated within the body of each outrigger 110, 120, or alternatively, include a magnetic sleeve that is attached to one or both outrigger 110, 120 to allow a user to secure and store the maintenance tool in areas having a metal foundation such as the back of a pickup truck. Further, it will be understood that although the pole support 100 shows a pair of outriggers 110, 120, additional outriggers may also be implemented if needed.

In an effort to prevent slippage and enhance the holding characteristics of the pole support 100, each outrigger 110, 120 may be provided with an enhanced friction material, covering or formation, denoted at 140. In one exemplary embodiment, the friction material 140 is used to increase the coefficient of friction to allow the pole support 100 to hold more firmly with a surface ledge, object, or pool wall when at rest. In a preferred embodiment, the friction material comprises a rubber material but other materials may be implemented. For example, other exemplary forms of friction material may include a particle based coating, a silicone covering, indentations, grooves, or ridges formed within the body of each arm, small bumps or protrusions, nubs, or shortened bristles. The friction material may be disposed on (e.g., sleeved on) the entire length of each outrigger HO, 120 or alternatively, the friction material may be disposed sleeved on) on intermittent portions or sections of each outrigger 110, and 120, if preferred.

Figure 3:
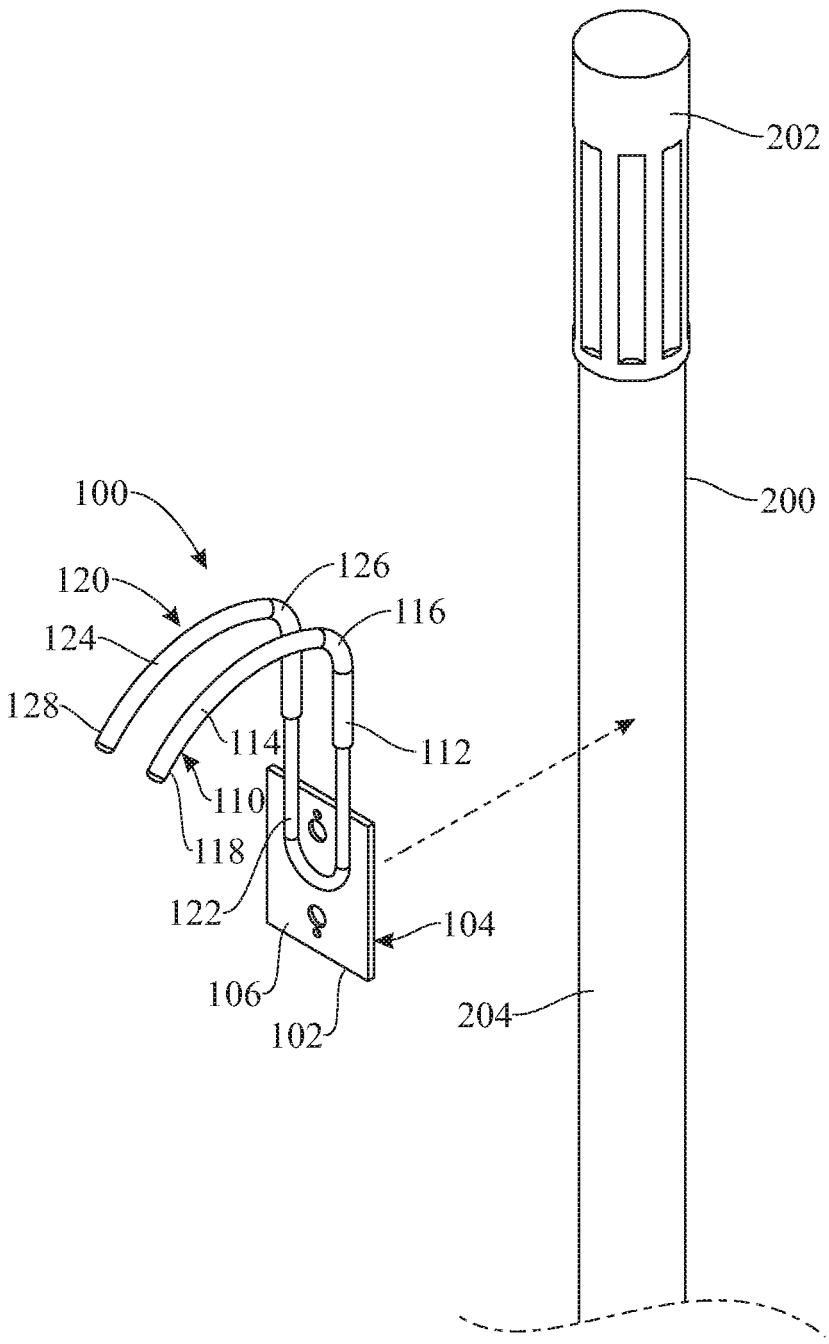
FIG. 3 presents an isometric view of the pole support of FIG. 1, shown readily, attachable to the outer surface of a pole of an illustrative pool maintenance tool shown as a partial view.
Figure 4:
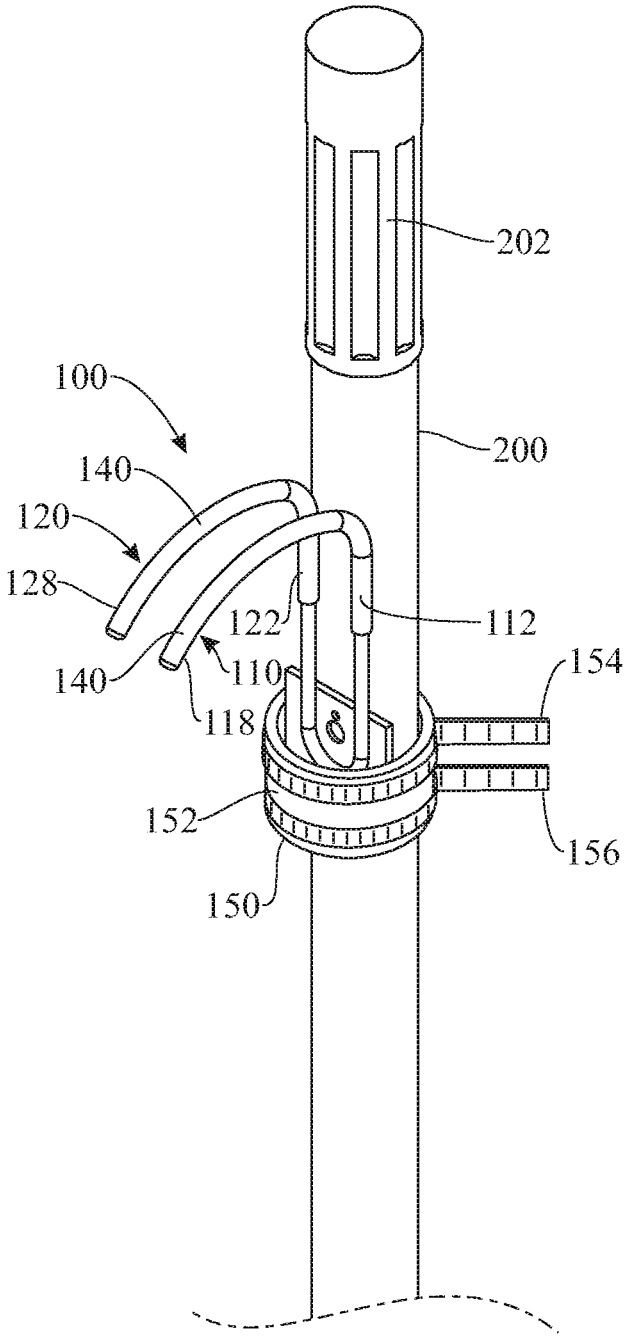
FIG. 4 presents an isometric view of the pole support and pole of FIG. 3; with the pole support shown adjustably attached to the outer surface of the pole with a fastener system.

As better illustrated in FIGS. 3 and 4, the pole support 100 is readily attachable to a pole 200 of a pool or spa maintenance tool, in accordance with an embodiment of the present invention. One exemplary form of a pool maintenance tool generally includes an elongate pole 200 having a handle 202 disposed at the distal end of the pole 200 for manipulating the tool during use. Though a partial view of the maintenance tool is shown, a tool accessory, such as, a net, skimmer, brush, or hook, is generally attached to the end of the pole 200. When attaching the pole support 100 to the pole 200, the pole support 100 is oriented such that the outer or front surface 104 of the support base 102 is oriented towards, or faces, an outer surface 204 of the pole 200, as denoted by the arrow in FIG. 3. The front surface 104 of the support base 102 engages with, or abuts against, the outer surface 204 of the pole 200, and a fastener system 150 is used to adjustably attach the support base 102 firmly to the pole 200, as illustrated in FIG. 4.

In one embodiment, the fastener system 150 comprises a resilient, flexible or pliable sleeve 152 that is wrapped around, or disposed over, the support base 102. The fastener system 150 further includes a pair of retaining bands 154, 156 that extend from or may be wrapped around the sleeve 152, where each retaining band 154, 156 is fastened or tightened to firmly compress the sleeve 152 and firmly secure and hold the pole support 100 in place against the pole 200. The sleeve 152 may comprise any of a rubber, plastic, or durable fabric material. For example, a rubber material may be selected to better protect against corrosion, abrasion, or harsh chemicals, including for example, a natural isoprene rubber, ethylene propylene diene (EPDM) rubber, silicone rubber, or other synthetic rubber. Retaining bands 154, 156 can include nylon tie wraps, brass or metal adjustable clamps, large metal or plastic cable ties, or hose or pipe clamps having band length adjustable screws. Alternatively or additionally to the depicted fastener system 150, other fasteners may be considered as well, including, but not limited to, wire, or rope. It will be understood that the fastener system 150 may comprise a variety of different mechanical components, systems, fasteners, or mechanical configurations that are selected and engineered to firmly attach the pole support 100 to pole 200. Further, the support base 102, of the pole support 100, may be secured to the pole 200 using one or more of an adhesive material, a hook-and-loop fastener or a magnetic fastener. Alternatively or additionally, the support base 102 may be secured to the pole 200 using a mechanical coupling system in which a bracket or support is affixed to the pole 200, and in which the support base 102 is removably attachable to the bracket using a fastener, bayonet connection, spring detents, or other mechanical attachment. One advantage of using an adjustable fastener system 150 is that it allows users to attach a pole support 100 anywhere along the length of pole 200. Thus, implementing a fastener system 150 that includes adjustable retaining bands 154, 156 allows a user to loosen the bands 154, 156, and move the pole support 100 to any desired positon along the length of pole 200. The adjustable fastener system 150 is convenient to better accommodate for the angle of elevation of the pole 200 when outriggers 110, 120 are resting on the edge of a pool wall or other surface area. Furthermore, a maintenance tool may have a short or long pole thereby requiring positional adjustment of the pool support 100 along the pole 200. As such, the adjustable feature of the fastener system 150 provides for a pole support 100 to be installed anywhere along the pole 200, of the maintenance tool 200, to accommodate pool or spa maintenance tools of different lengths, sizes, or dimensions.

As shown in FIG. 4, upon mounting the pool support 100 to the outer surface of the pole 200, the friction material 140 provided or disposed on the first segments 112, 122 of the outriggers 110, 120 engages with the outer surface 204 of the pole 200 to further enhance the stability of the pole support 100 when mounted on the pole 200 and to prevent the pole support 100 from swaying back and forth about a vertical axis while on the pole 200.

Figure 5:
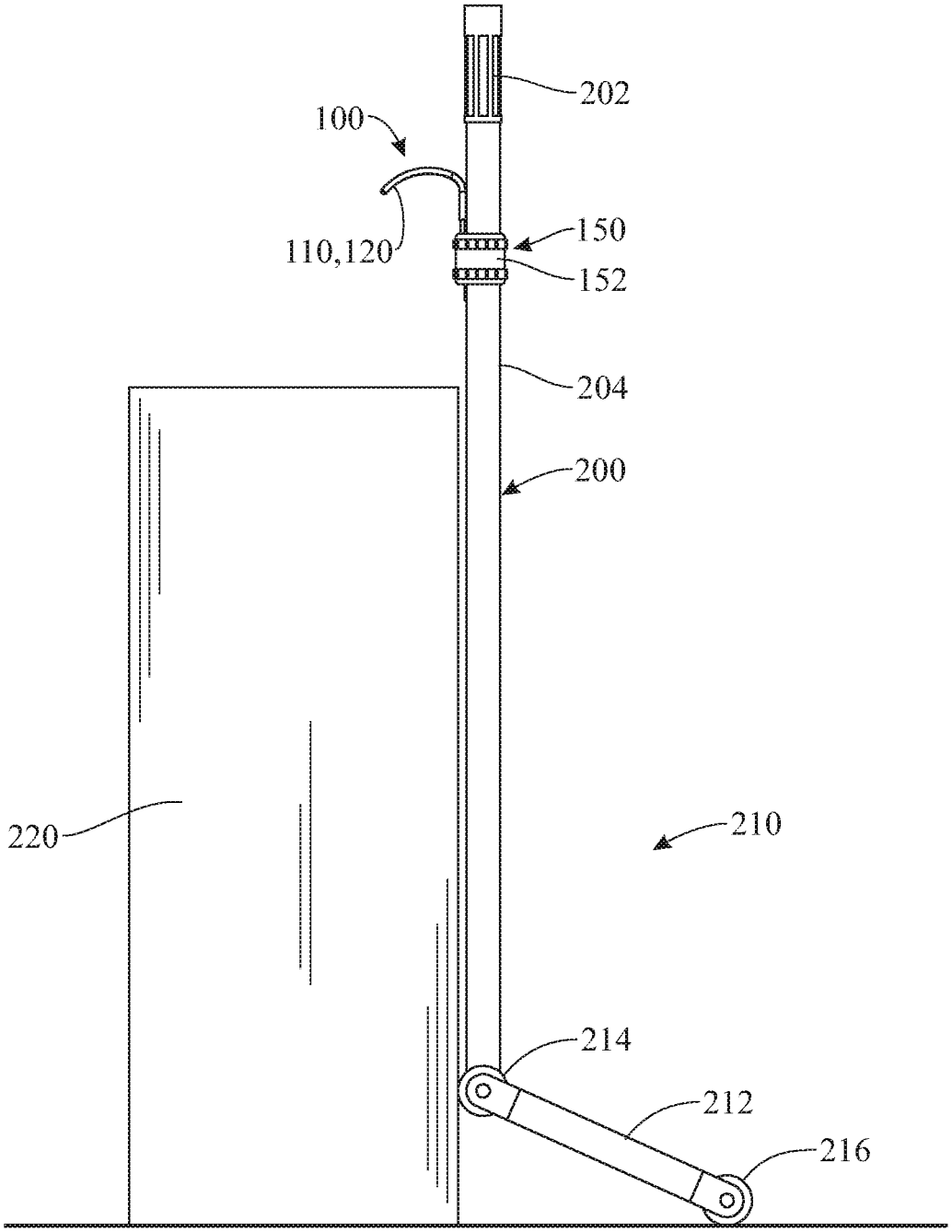
FIG. 5 presents a side elevation view of a pool maintenance tool including a vacuum plate with wheels pivotably attached to one end of a pole, and including the pole support and fastener system of FIG. 4, showing the tool readily separable from a pool wall.

With reference made to FIG. 5, there is shown a side view of a pool maintenance tool 210 including a pole 200 having a handle 202, and further including a vacuum plate 212 that is pivotably attached to the end of pole 200 and is provided with wheels 214, 216. The figure shows the pool maintenance tool abutting against a pool wall 220, in accordance with an embodiment of the present invention. The pool maintenance tool 210 depicted herein is an example of a tool often used with pools which typically includes a vacuum system that is maneuvered along the bottom surface of a pool to vacuum any debris or dirt that has accumulated at the bottom of the pool. When not in use, the pool maintenance tool 210 may be initially set aside by the user in a sloped position of FIG. 6 (with the pole support 100 contacting the pool wall 220) or in an uptight position as shown for instance in FIG. 5 (with the pole support 100 elevated from the pool wall 220). In the event of setting the tool aside in the position of FIG. 6, the pole support 100 engaging the pool wall 220 prevents the pool maintenance tool 210 from sliding downward, further into the pool. If, instead, the user chooses to set the tool in the position of FIG. 5, and the tool starts to slip downward, the pole support 100 eventually engages the pool wall 220 (FIG. 5) and prevents the pool maintenance tool 210 from sliding further downward into the pool. When the pool maintenance tool 210 is retained in place by the pole support 100, the top end (handle 202) of the pool maintenance tool 210 extending upward of the pole support 110 facilitates the user grasping the pool maintenance tool 210 to reposition the tool or subsequently use the tool. In summary, the pole support 100 provides the benefit of retaining the pool maintenance tool 210 in a relatively elevated position at rest on the surface ledge of the pool wall 220, without having to worry that the pool maintenance tool 210 will slip and fall entirely into the pool, and also facilitates setting the tool aside and once more grasping the tool for subsequent use.

Figure 6:
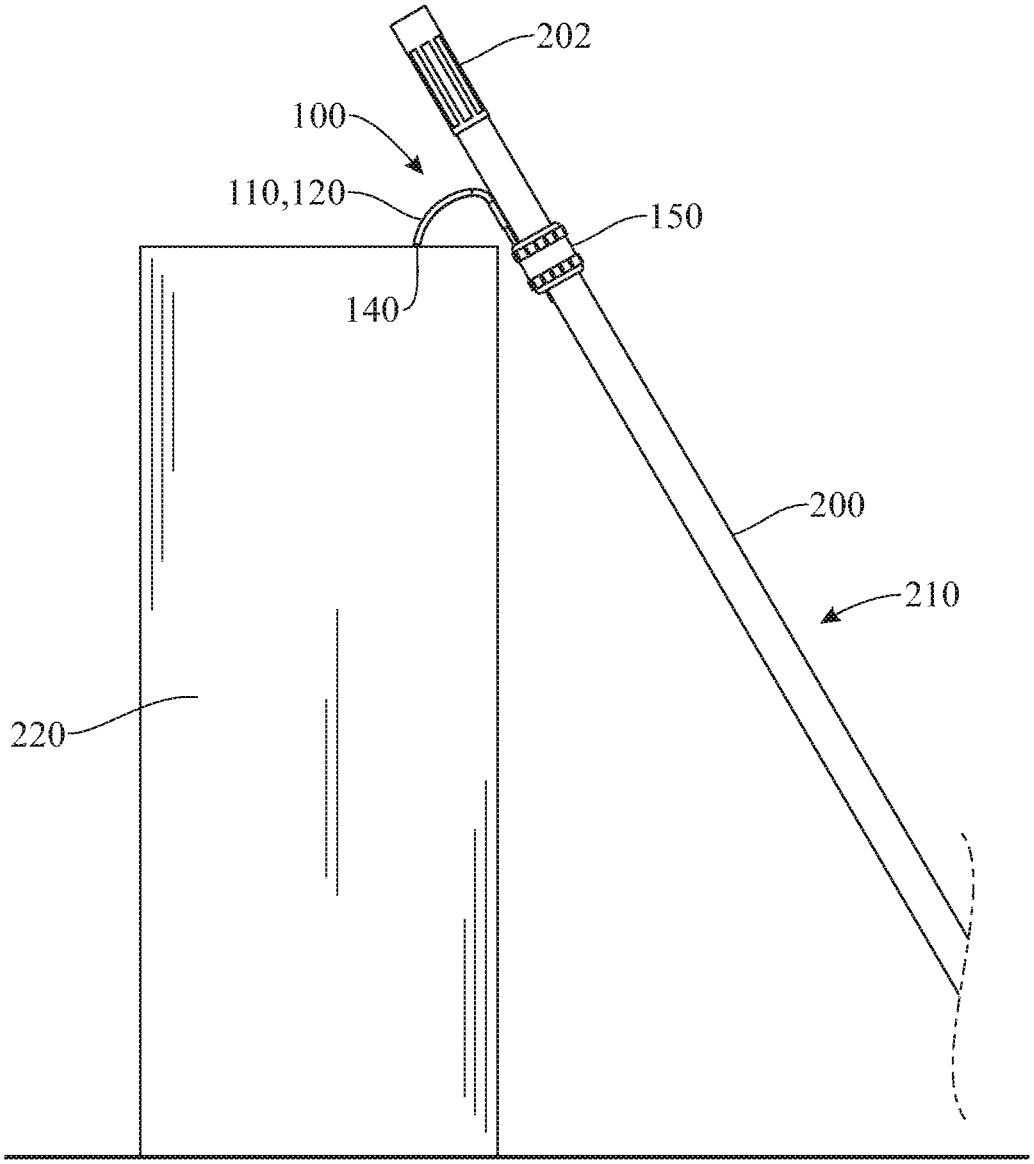
FIG. 6 presents a side view of the pool maintenance tool of FIG. 5, showing outriggers of the pool support resting on the surface ledge of a pool wall to hold the maintenance tool in place and prevent the maintenance tool from slipping and falling into the pool.

With continued reference to FIG. 6, when the pole support 100 is retaining the pool maintenance tool 210 in place relative to the pool wall 210, the outriggers 110, 120 of the pole support 100 are disposed onto the surface edge of the pool wall 220. The friction material 140 provided for on each outrigger 110, 120 enhances the friction contact between the pool wall 220 and outriggers 110 and 120. Although a surface edge of a pool wall 220 depicts a holding platform for pole support 100, it will be understood that the pole support 100 may be used in conjunction with a large variety of surface edges or areas. For example, the outriggers 110, 120 can be placed on any surface edge desired, such as a table, a chair, a container, rails, hand railings, stairs, or other equipment associated with or used in conjunction with pools or spas.

Figure 7:
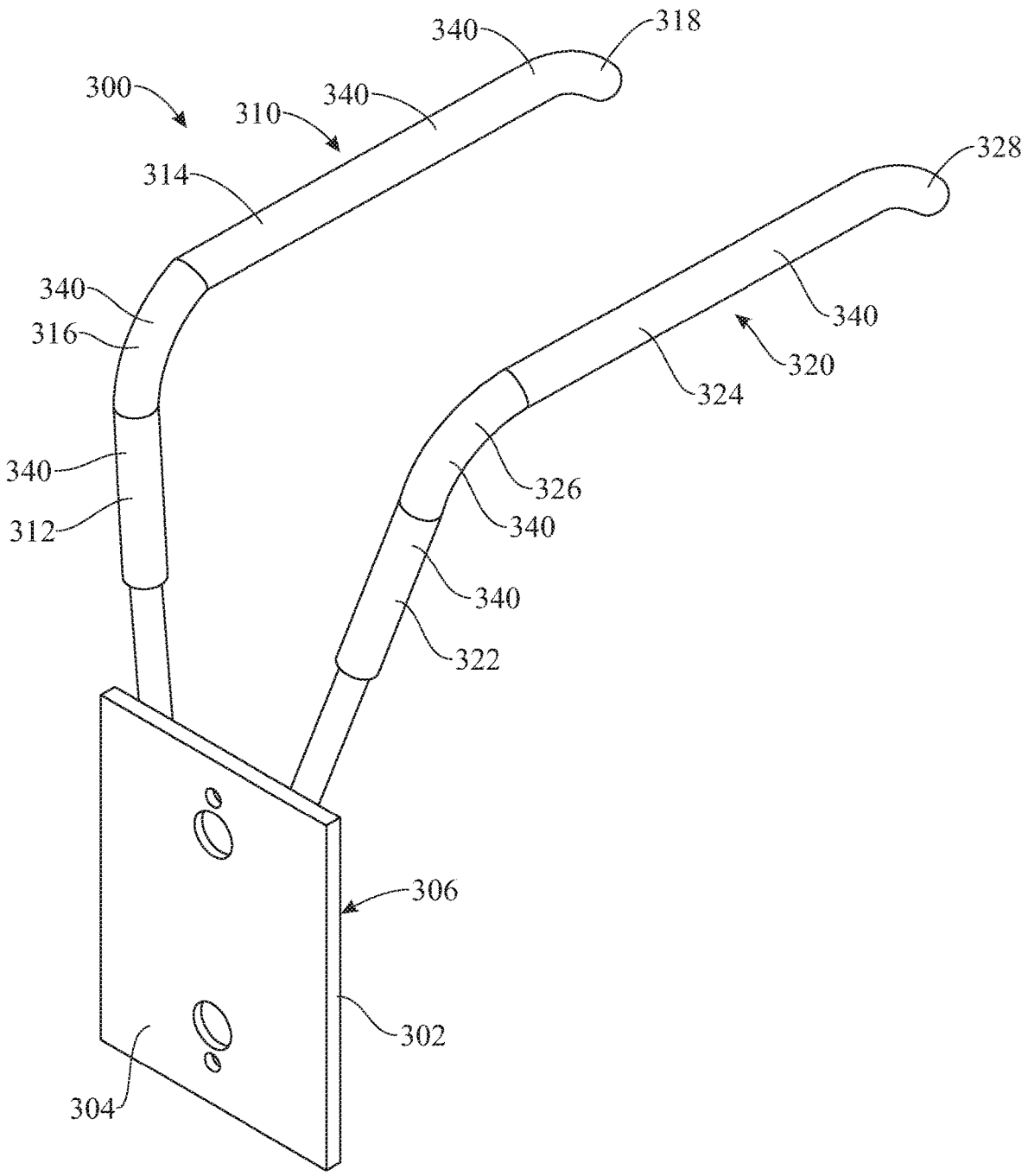
FIG. 7 presents a top, front isometric view of a pole support in accordance with a second illustrative embodiment of the present invention.

Turning to FIG. 7, there is shown a perspective view of a pole support 300 readily attachable to a pole of a pool maintenance tool, in accordance with an alternative embodiment of the present invention. The pole support 300 includes a support base 302 having a front surface 304 and a rear surface 306. The pole support 300 further includes a pair of arms or outriggers 310, 320 that are each coupled to the support base 302 in a flared configuration such that each outrigger 310, 320 is flared apart from one another a predetermined distance. As shown, each outrigger 310, 320 is defined by a first segment 312, 322 that extends upwards from the support base 302, a second segment 314, 324 extending rearward of the support base 302, and a connecting portion 316, 326 connecting each first segment 312, 322 to the respective second segment 314, 324. In the present embodiment, the first segments 312, 322 are not parallel to one another, but rather extend at an angle from the vertical axis, forming a V-shaped arrangement with one another; however, alternative embodiments are contemplated. Furthermore, as shown, the first segments 312, 322 and/or second segments 314, 324 may be straight, although alternative embodiments are contemplated. The straight, second segments 314, 324 may be parallel to one another, as shown, or non-parallel to one another. As illustrated in the embodiment, the distal end 318, 328 of the second segment 314, 324 of each outrigger 310, 320 may include a curvature or bend to provide a hook configuration for firmly engaging the pole support 300 with a surface to prevent a tool from slipping off and falling into a pool. In a preferred embodiment, pole support 300 further includes a friction material 340 to increase the coefficient of friction and to prevent the outriggers 310, 320 from slipping off a holding surface, such as a pool wall (e.g. pool wall 220 of FIGS. 5 and 6) and 5). As noted, the friction material 340 can be applied to or disposed on (e.g., sleeved on), the entire length of each outrigger 310, 320, or alternatively, disposed on (e.g., sleeved on) selected portions of each outrigger 310 and 320. The flared configuration of the outriggers 310, 320 may be employed to provide several advantages. For example, the flared outriggers 310, 320 may enhance the holding stability of a pool maintenance tool when the outriggers 310, 320 are placed on a pool wall to prevent tilting or wobbling of the tool. The increased spacing between outriggers 310, 320 may provide greater space to allow a user to grasp or hold on to the pole 200 when extending between the outriggers 310, 320 when the support base 302 is attached to the pole 200. Furthermore, the pole support 300 may be able to be used with poles 200 having a larger size diameters.

Figure 8:
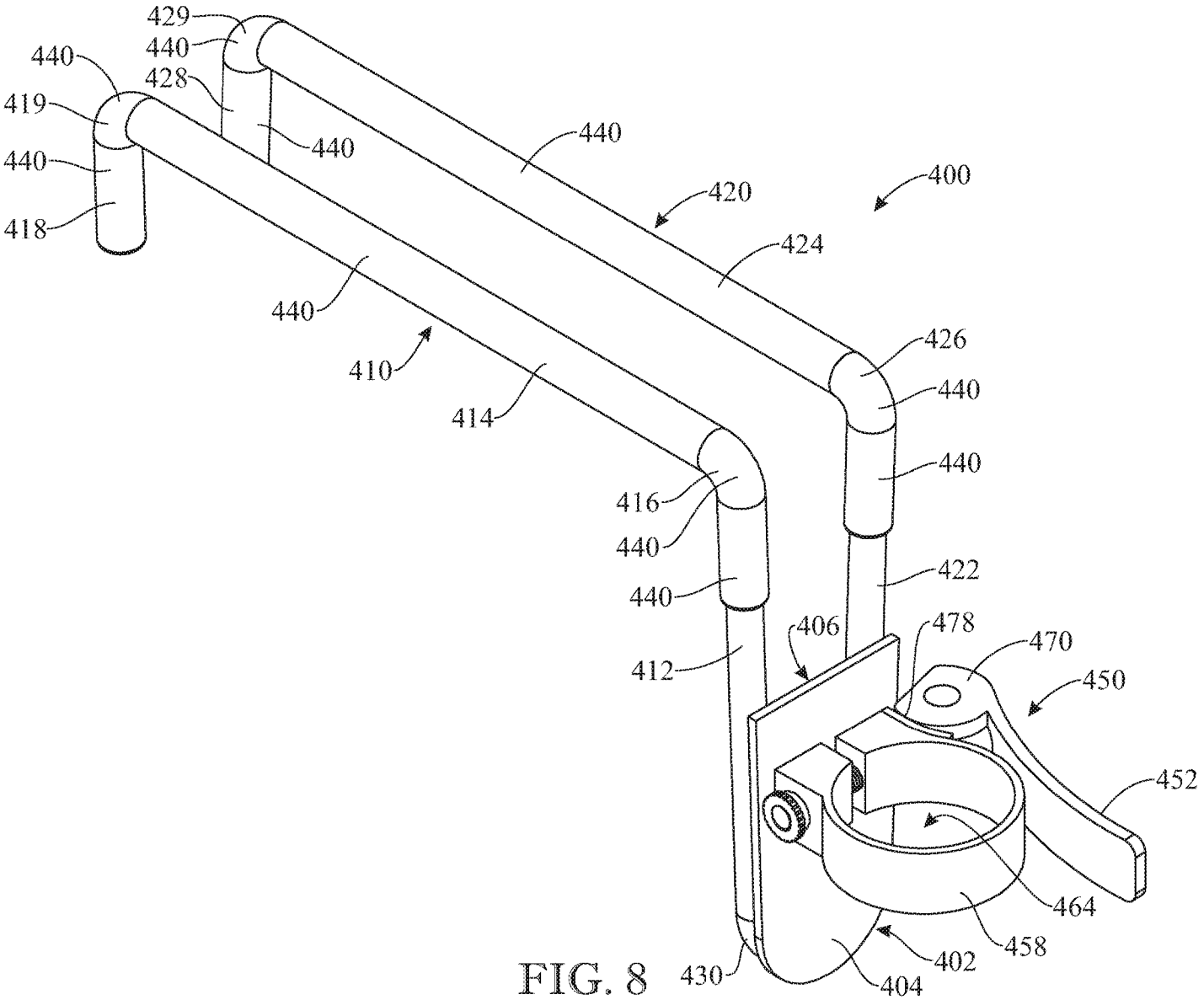
FIG. 8 presents a top, front isometric view of a pole support including outriggers attached to a support base, the pole support comprising a quick release cam lock fastener system, in accordance with a third illustrative embodiment of the present invention.

The illustrations of FIGS. 8-13 show a pole support 400 in accordance with a third illustrative embodiment of the present invention. Referring initially to FIG. 8, the pole support 400 includes a support base 402 having a front surface 404 and a rear surface 406. Similarly to the previous embodiments, the support base 402 is formed as a flat plate with the front and rear surfaces 404 and 406 parallel to one another. However, the support base 402 depicted herein is non-rectangular and includes rectilinear top and side edges, and a curved bottom edge. Notwithstanding, the present embodiment can be constructed using support bases of alternative shapes and sizes, including but not limited to those of the previous embodiments.

Similarly to the previous embodiments, the pole support 400 of the present embodiment includes a pair of arms or outriggers 410, 420 that are each coupled to the support base 402. As shown, each outrigger 410, 420 is defined by a first segment 412, 422 that extends upwards from the support base 402, a second segment 414, 424 extending rearward of the support base 402, and a connecting portion 416, 426 connecting each first segment 412, 422 to the corresponding second segment 414, 424. As described heretofore with reference to previous embodiments, the outriggers 410, 420 may be formed as separate parts or comprised in a single piece, such as connected by an optionally U-shaped connecting segment 430.

Similarly to the second embodiment, the first segments 412, 422 of the present embodiment are divergent from one another, i.e. extend at a slight angle from a vertical axis, forming a slightly flared or V-shaped arrangement with one another. However, alternative embodiments are contemplated without departing from the scope of the present disclosure. Furthermore, the first segments 412 and 422 and/or second segments 414 and 424 may be straight, as shown, although alternative embodiments are contemplated. The straight, second segments 414, 424 may be parallel to one another, as shown, or non-parallel to one another. As illustrated, similarly to previous embodiments, a distal end 418, 428 of each second segment 414, 424 may include a curvature or bend to provide the outriggers 410, 420 with a hook-type configuration for firmly engaging the pole support 400 with a surface to prevent a tool from slipping off and falling into a pool. More specifically, in the present embodiment, each second segment 414, 424 and the corresponding distal end 418, 428 are straight, and each distal end 418, 428 extends downward from and perpendicularly to the corresponding second segment 414, 424, and is connected to the corresponding second segment 414, 424 by a connecting portion 419, 429, which may be curved. Similarly, each first segment 412, 422 is straight and extends downward from and perpendicularly to the corresponding second segment 414, 424, and is connected to the corresponding second segment 414, 424 by the aforementioned connecting portions 416, 426, which may be curved. In some embodiments, as shown, each straight distal end 418, 428 may be parallel to the corresponding first segment 412, 422 and the straight distal ends 418, 428 may diverge, i.e, extend at a slight angle from a vertical axis, forming a slightly flared or V-shaped arrangement with one another, similarly to the first segments 412, 422.

Figure 12:
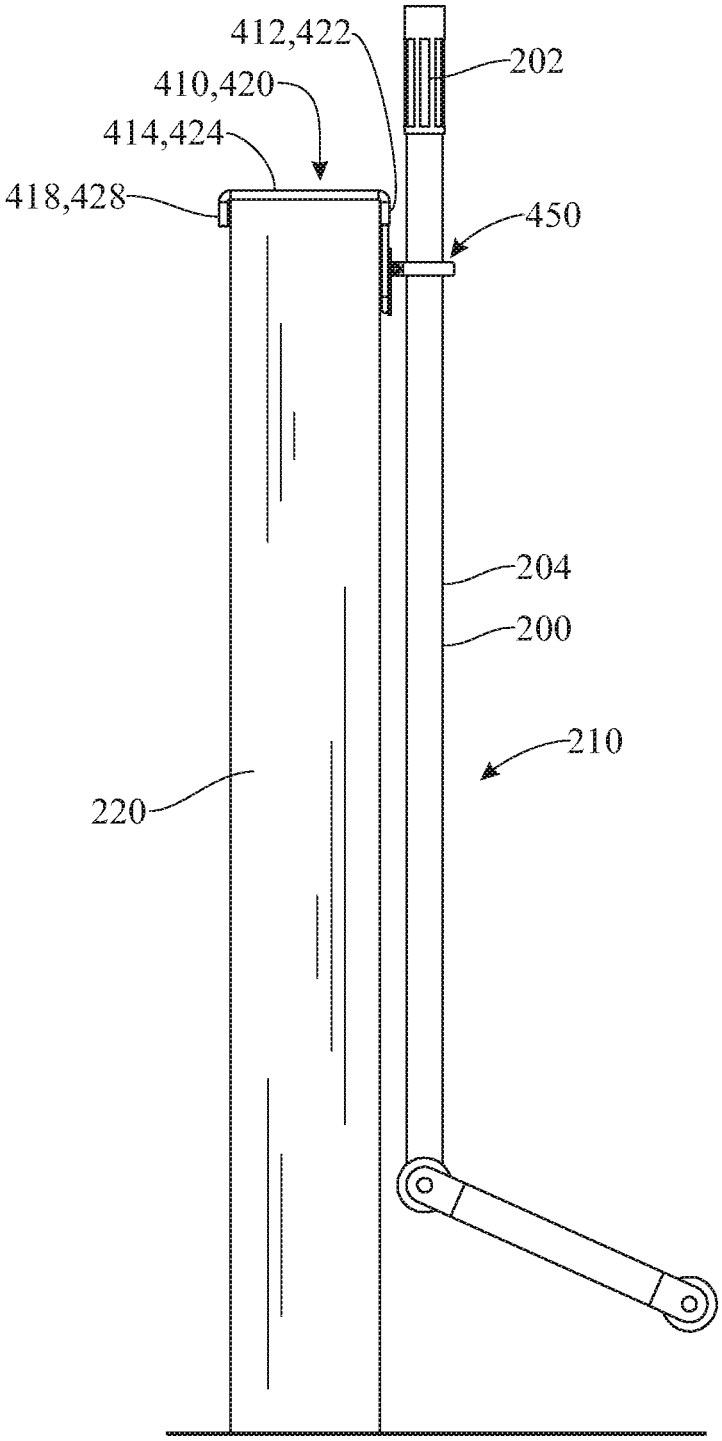

Similarly to previous embodiments, pole support 400 may include a friction material 440 to increase the coefficient of friction and to prevent the outriggers 410, 420 from slipping off a holding surface, such as a pool wall 220 (FIG. 12). As noted, the friction material 440 can be applied to or disposed on (e.g., sleeved on), the entire length of each outrigger 410, 420, or alternatively, disposed on (e.g., sleeved on) selected portions of each outrigger 410 and 420.

Figure 9:
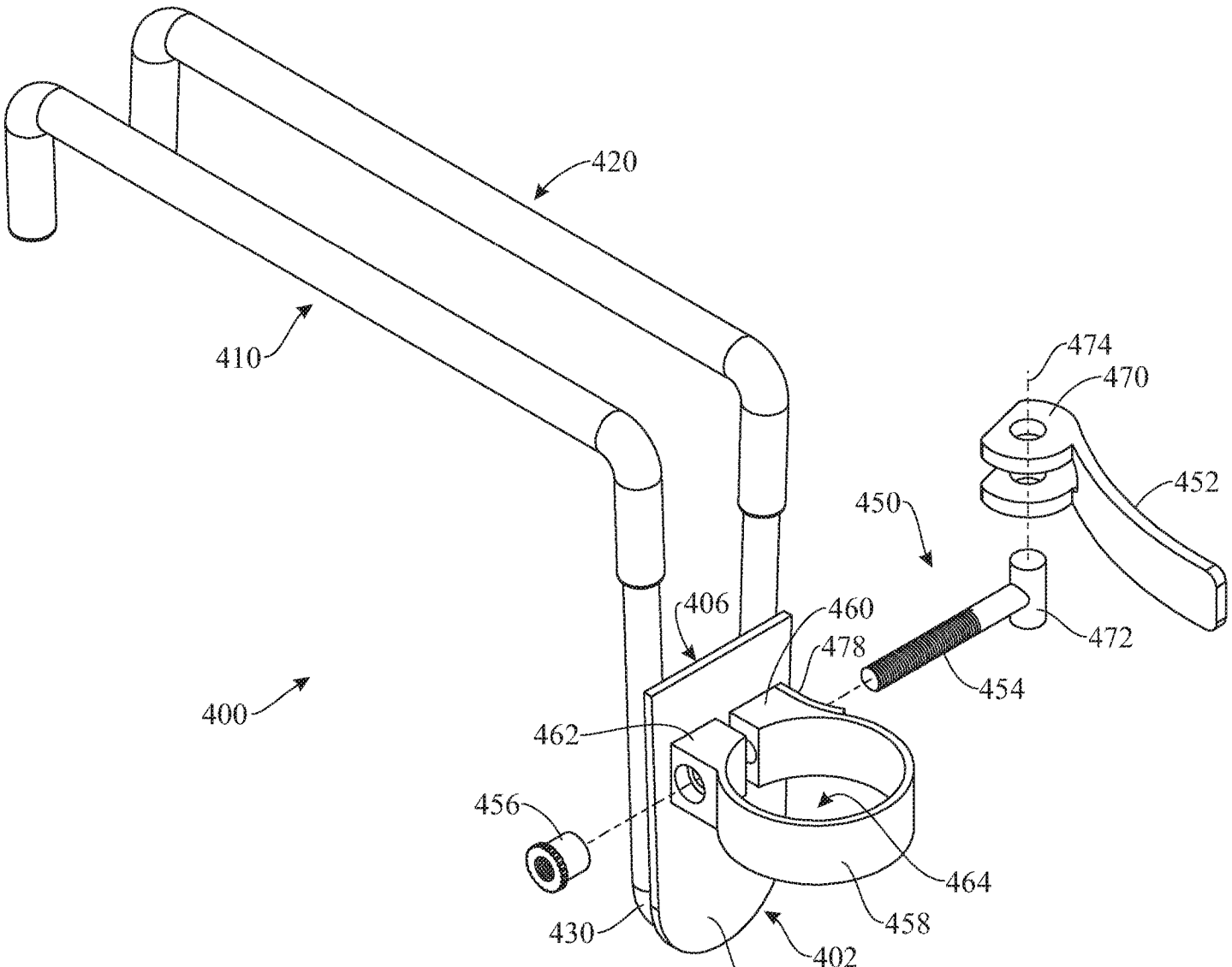
FIG. 9 presents a top, front isometric view of the pole support of FIG. 8, with the quick release cam lock fastener system shown exploded.

Also similarly to previous embodiments, the pole support 400 includes a fastener system 450 configured to attach the pole support 400 to a pole of a pool/spa maintenance tool (e.g. pole 200 of pool maintenance tool 210 of FIG. 12). The fastener system 450 depicted herein consists of a quick release cam lock fastener, which, as best shown in FIG. 9, includes a pivotable handle 452, a threaded bolt 454, a nut 456 and a deformable split ring body 458 configured to slide on a pole. The split ring body 458 ends in opposite split ring ends 460, 462 and defines an interior space 464 configured to receive the pole therethrough. The split ring body 458 may compress or expand to respectively reduce or increase the size of the interior space 464. One of the split ring ends 460, 462 is permanently attached to the support base 402 (e.g., to the front surface 404 of the support base 402) while the other of the split ring ends 460, 462 is not attached to the support base 402. For instance and without limitation, in the present embodiment, split ring end 460 is permanently and non-movably attached to the front surface 404 of the support base 402, while split ring end 462 is a free end that may move towards and away from the split ring end 460 as the split ring body 458 compresses or expands.

The handle 452 comprises a cam portion 470 pivotably attached to a head 472 of the threaded bolt 454, such that the cam portion 470, and thus the entire handle 452, may rotate towards and away the split ring body 458 about a rotation axis 474. The threaded bolt 454 extends non-threadingly (i.e. loosely) through the split ring ends 460, 462. The nut 456 is threaded to an end of the threaded bolt 454 opposite to the head 472, thereby retaining the threaded bolt 454 in place, i.e. extending through the split ring ends 460, 462, A contact surface 478 is provided on the split ring end 460 facing the cam portion 470. The cam portion 470 is shaped and sized so that, in dependence of the rotational position of the cam portion 470 relative to the contact surface 478, the cam portion 470 causes the split ring body 458 to compress or allows the split ring body 458 to expand.

Figure 10:
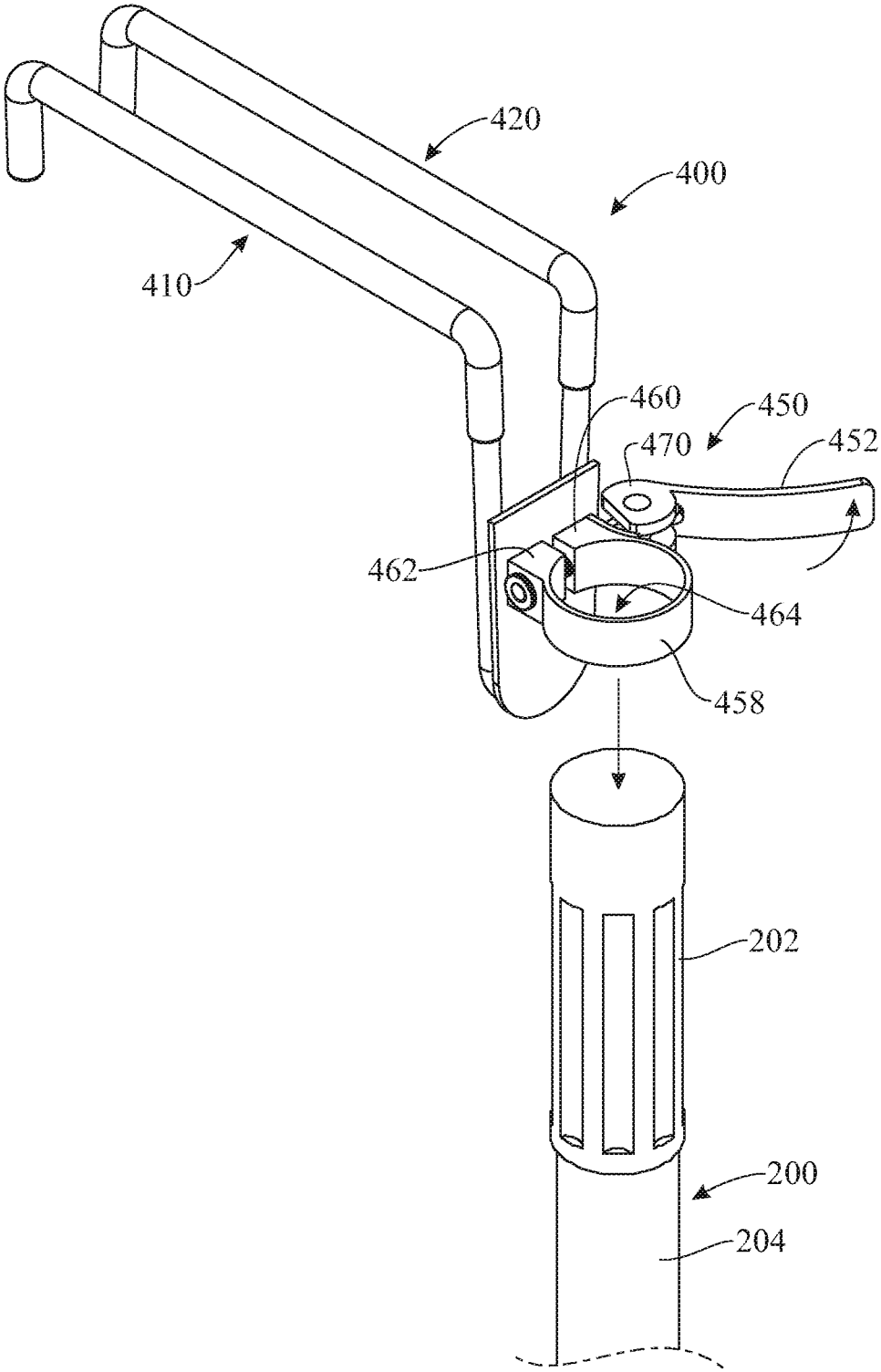
FIG. 10 presents a top, front isometric view of the pole support of FIG. 8 being assembled on a pole, with the quick release cam lock fastener system shown in an open or released position.

More specifically, the fastener system 450 may adopt an open or expanded position shown in FIG. 10, by rotating the handle 452 away from the split ring body 458. Rotation of the handle 452 away from the split ring body 458 causes the cam portion 470 to relieve, or cease to exert, a force on the contact surface 478 and provides room for the split ring ends 460, 462 to separate and the split ring body 458 to expand, thereby increasing the size of the interior space 464. In this expanded position, the split ring body 458 may easily be fitted onto the pole 200, such as over the handle 202 as shown in the drawing, and slid to the desired position along the pole 200.

Figure 11:
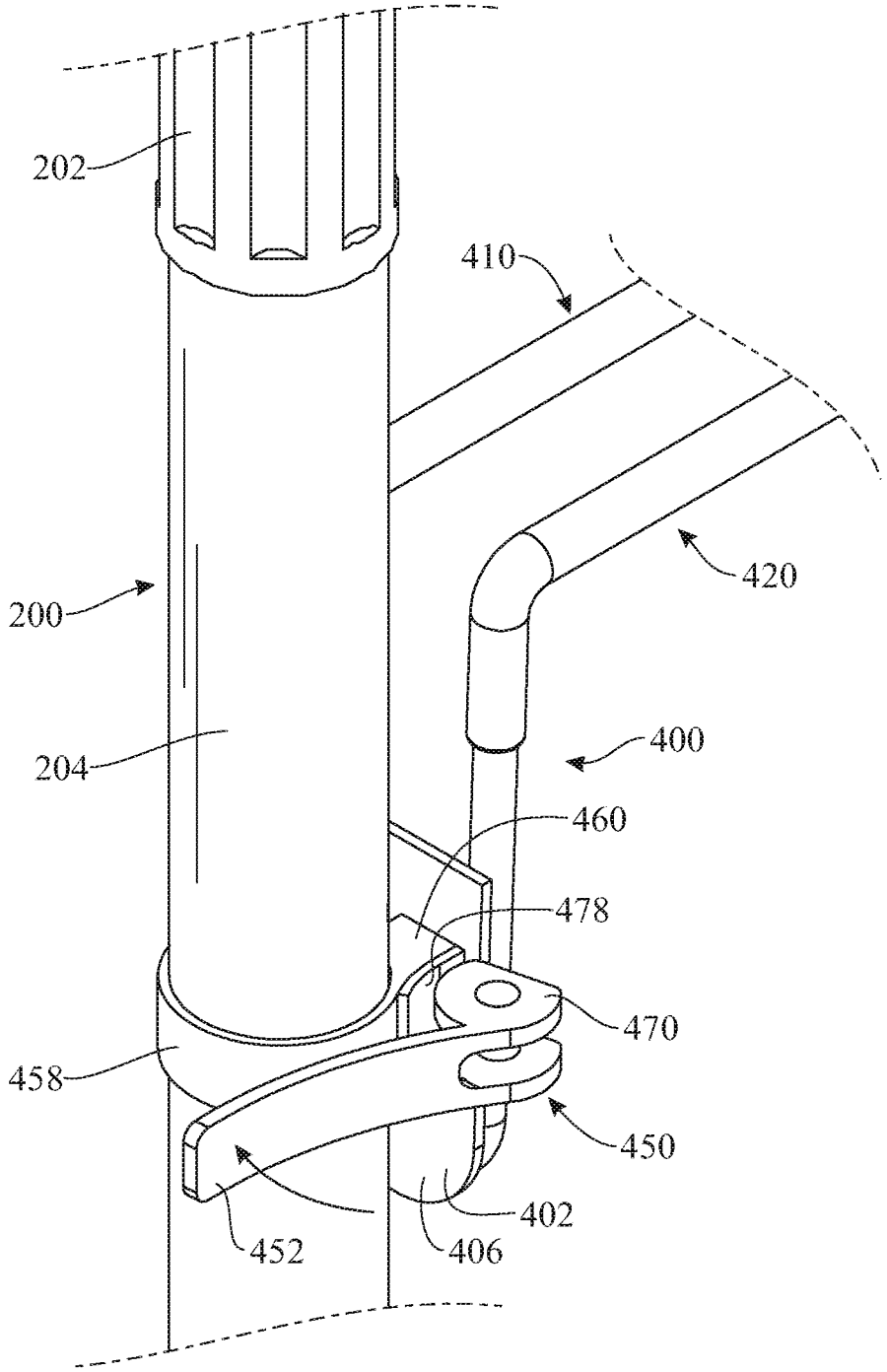
FIG. 11 presents a top; front isometric view of the pole support and pole of FIG. 10, showing the pole support mounted on the pole with the quick release cam lock fastener system adjusted to a closed or tightened position.

Turning to FIG. 11, once the split ring body 458 has been adequately positioned on the pole 200, the user may rotate the handle 452 towards the split ring body 458 and cause the cam portion 470 to rotate and, due to the non-circular geometry of the cam portion 470, exert a sufficient force on the contact surface 478 to produce a reaction force one the cam portion 470 which causes the cam portion 470 to pull the bolt 454. Consequently, the bolt 454 pulls the nut 456 towards the cam portion 470, which causes the bolt 454 to push the movable split ring end 462 towards the fixed split ring end 460 and thereby compress the split ring body 458 and tighten the spring ring body 458 against the pole 200.

It must be noted, however, that in other embodiments of the invention, the fastener system may include alternative or additional fasteners, which may be permanently or non-permanently attached to the support base 402.

Figure 13:
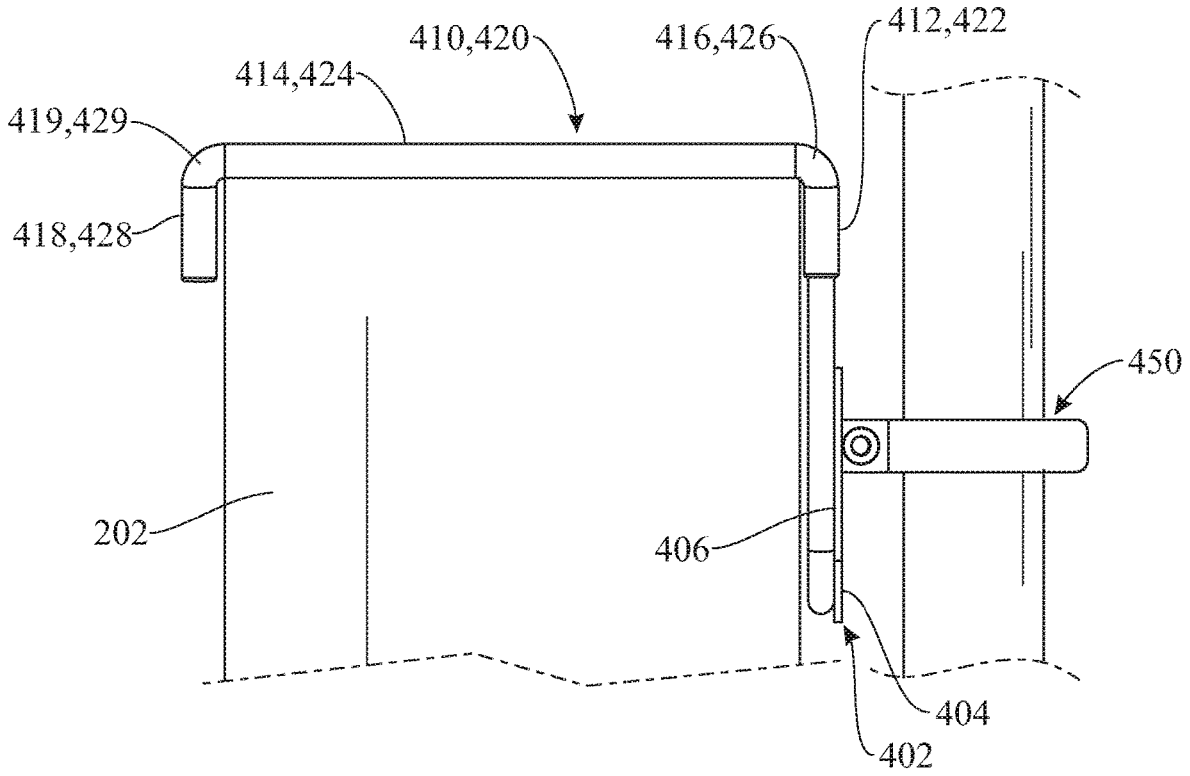
FIG. 13 presents an enlarged, side elevation view of the area of FIG. 12 showing the hooked attachment between the pole support and the pool wall.

The illustrations of FIGS. 12 and 13 show the pole support 400 of the present embodiment securing an illustrative pool maintenance tool 210 to a pool wall 220 ending in a top rectangular end. As shown, the right-angled configuration formed between the distal end 418, 428, the corresponding second segment 414, 424 and the corresponding first segment 412, 422 of each outrigger 410, 420 allows each outrigger 410, 420 to snugly adjust with the rectangular contour of the top end of the pool wall 220 and further reduce the chances of the pool maintenance tool 210 slipping into the pool.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A pole support for a pool or spa maintenance tool, comprising:

a support base releasably attachable to a pole of a pool maintenance tool;

a first outrigger attached to the support base, the first outrigger comprising a first segment extending generally upwards from the support base and a second segment conjoined with the first segment and extending generally rearward of the support base;

a second outrigger attached to the support base, the second outrigger comprising a first segment extending generally upwards from the support base and a second segment conjoined with the first segment and extending generally rearward of the support base; and a quick release cam lock fastener system configured to attach the support base to the pole with a front side of the support base abutting against the pole.

2. The pole support of claim 1, wherein the first outrigger and second outrigger form part of a single-piece unit, the single-piece unit further comprising a U-shaped connecting portion connecting the first outrigger to the second outrigger, wherein the U-shaped connecting portion is attached to a rear surface of the support base.

3. The pole support of claim 1, wherein the first segment of the first outrigger and the first segment of the second outrigger are parallel to each other.

4. The pole support of claim 1, wherein the first segment of the first outrigger and the first segment of the second outrigger are divergent from each other.

5. The pole support of claim 1, wherein the first segment of the first outrigger and the first segment of the second outrigger are straight.

6. The pole support of claim 1, wherein the second segment of the first outrigger and the second segment of the second outrigger are curved.

7. The pole support of claim 1, wherein the second segment of the first outrigger and the second segment of the second outrigger are straight.

8. The pole support of claim 7, wherein the first segment of the first outrigger and the first segment of the second outrigger are straight, and further wherein the first and second segments of the first outrigger are perpendicular to each other and the first and second segments of the second outrigger are perpendicular to each other.

9. The pole support of claim 1, wherein at least one of the first and second outriggers comprises a friction material disposed thereon to prevent slippage when said at least one of the first and second outriggers rests on a surface.

10. The pole support of claim 9, wherein both the first and second outriggers include a friction material disposed on the first and second segments thereof to prevent slippage when said first and second outriggers rest on a surface.

11. The pole support of claim 1, wherein the first outrigger comprises a distal end conjoined with the second segment of the first outrigger and the second outrigger comprises a distal end conjoined with the second segment of the second outrigger, and further wherein the distal ends of the first and second outriggers extend generally downward of the second segment of the first and second outriggers, respectively, each of the first and second outriggers forming a hook-type configuration.

12. The pole support of claim 11, wherein the distal ends of the first and second outriggers are straight.

13. The pole support of claim 11, wherein the distal ends of the first and second outriggers are curved.

14. The pole support of claim 11, wherein the distal ends of the first and second outriggers include a friction material disposed thereon to prevent slippage when said distal ends rest on a surface.

15. The pole support of claim 1, wherein the fastener system comprises a flexible sleeve configured to wrap around the pole.

16. The pole support of claim 1, wherein the fastener system is removably connectable to the support base.

17. The pole support of claim 1, wherein the quick release cam lock fastener system is permanently carried by the support base.

18. A pole support for a pool or spa maintenance tool, comprising:

a support base releasably attachable to a pole of a pool maintenance tool;

a first outrigger attached to the support base, the first outrigger comprising a first segment extending generally upwards from the support base, a second segment conjoined with the first segment and extending generally rearward of the support base, and a distal end conjoined with the second segment of the first outrigger and extending generally downward of the second segment of the first outrigger such that the first outrigger presents a hook-type configuration;

a second outrigger attached to the support base, the second outrigger comprising a first segment extending generally upwards from the support base, a second segment conjoined with the first segment and extending generally rearward of the support base, and a distal end conjoined with the second segment of the second outrigger and extending generally downward of the second segment of the second outrigger such that the second outrigger presents a hook-type configuration; and a quick release cam lock fastener system configured to attach the support base to the pole with a front side of the support base abutting against the pole.

19. A pole support for a pool or spa maintenance tool, comprising:

a support base releasably attachable to a pole of a pool maintenance tool;

a first outrigger attached to the support base, the first outrigger comprising a first segment extending generally upwards from the support base, a second segment conjoined with the first segment and extending generally rearward of the support base, and a distal end conjoined with the second segment of the first outrigger and extending generally downward of the second segment of the first outrigger such that the first outrigger presents a hook-type configuration;

a second outrigger attached to the support base, the second outrigger comprising a first segment extending generally upwards from the support base, a second segment conjoined with the first segment and extending generally rearward of the support base, and a distal end conjoined with the second segment of the second outrigger and extending generally downward of the second segment of the second outrigger such that the second outrigger presents a hook-type configuration; and a quick release cam lock fastener system configured to attach the support base to the pole with a front side of the support base abutting against the pole; wherein the first outrigger and second outrigger form part of a single-piece unit, the single-piece unit further comprising a U-shaped connecting portion connecting the first outrigger to the second outrigger, wherein the U-shaped connecting portion is attached to a rear surface of the support base.

* * * * *